United States Patent [19]

Bryant

[11] 4,164,851

[45] Aug. 21, 1979

[54] BEVERAGE CONTAINER COOLER

[76] Inventor: Jon A. Bryant, P.O. Box #3, Forestdale, Vt. 05745

[21] Appl. No.: 846,484

[22] Filed: Dec. 19, 1977

[51] Int. Cl.[2] ..... F25D 25/02

[52] U.S. Cl. ..... 62/381; 62/457; 62/466

[58] Field of Search ..... 62/62, 63, 381, 457, 62/466

[56] References Cited

U.S. PATENT DOCUMENTS

| | | | |
|---|---|---|---|
| 714,415 | 11/1902 | Trafford | 62/457 |
| 2,216,762 | 10/1940 | Bolas | 62/381 |
| 3,316,734 | 5/1967 | Grane, Jr. | 62/63 |
| 4,078,397 | 3/1978 | Brande | 62/457 |

*Primary Examiner*—Ronald C. Capossela
*Attorney, Agent, or Firm*—James J. Cannon, Jr.

[57] ABSTRACT

A device for rapidly cooling a canned or bottled beverage having a cooling compartment in which two rollers are horizontally disposed to support and cause to rotate a horizontally positioned cylindrical beverage container, an ice retaining member angularly disposed within said cooling compartment to support a quantity of ice in frictional contact with the perimeter surface of said beverage container and an electrical motor causing said rollers to rotate through a gear mechanism. Rapid rotation of the beverage container in frictional contact with a chilling substance such as ice results in a very rapid chilling of the contents of the beverage container.

3 Claims, 4 Drawing Figures

BEVERAGE CONTAINER COOLER

BACKGROUND OF THE INVENTION

1. Field of the Invention

This invention pertains to the field of cooling devices, and specifically to electro-mechanical devices which effect the cooling of the contents of a beverage container by rapidly rotating the container along its longitudinal axis in proximity to a cold substance. Specifically, the device of the present invention will rotate a standard twelve ounce beverage container 300 rpm in proximity to a few ice cubes and reduce the temperature of the contents by thirty degrees F. in approximately two minutes.

2. Description of the Prior Art

It is well known that a generally cylindrical container of liquid may be rapidly cooled by rotating the container about its longitudinal axis while the container is disposed in a bucket of ice. It is further well known that cooling is effected more quickly as the speed of rotation is increased. This practice is commonly used to chill bottles of wine in restaurants. However, manual rotation or oscillation of the beverage container is time consuming and thus costly to a business establishment. In addition, the speed of rotation achieved by manual means is usually very low and prolongs the time to chill the beverage.

Two prior U.S. patents have disclosed motorized rotational devices to effect the rapid chilling of beverages in containers. U.S. Pat. No. 2,216,762, issued to Bolas, discloses an ice bucket having attached thereto a motor driven mechanism specifically designed to rotate a bottle of wine substantially inserted within the ice bucket. The mechanism of this invention is extremely complex, too expensive to manufacture and is specifically limited to bottles. U.S. Pat. No. 3,316,734, issued to Crane, discloses an apparatus for cooling canned liquids. This apparatus is impractical to use, expensive to manufacture and is specifically limited to cans. Furthermore, it may not, in some of its embodiments, meet present standards of electrical safety.

The device of the present invention is designed to solve a specific problem. Many canned and bottled beverages such as beer, wine, carbonated drinks and fruit-based drinks should be served at a temperature of about 40° F. Many of these beverages should not be diluted by the addition of ice cubes. It is economically unfeasible and usually physically impractical to refrigerate the entire inventory of canned and bottled beverages of a restaurant or a home. The usual storage temperature of such beverages ranges from 65° F. to 75° F. Even in a refrigerated supermarket case, the temperature is about 50° to 55° F. By the time a refrigerated beverage is transported from a supermarket to a home, its temperature has risen about ten degrees. The problem, thus, is how to rapidly chill a canned or bottled beverage to the proper serving temperature, so that it may be served within a few minutes.

The principal object of the present invention is to provide a motorized rotational cooling device which will cool canned and bottled beverages to a proper serving temperature in minutes.

It is a further object of this invention to provide such a device which is very inexpensive to manufacture, very simple and safe to use and will satisfy the requirements of both domestic and commercial use.

SUMMARY OF THE INVENTION

This invention pertains to a motorized rotational cooling device for the rapid chilling of canned and bottled beverages. The cooling device is installed in a housing having two interior compartments, one of which is fabricated from a clear, transparent plastic material. The housing has a hinged top which, when opened, permits access to each of said compartments. One of said compartments, the larger of the two, is the cooling compartment, and the second, smaller compartment, is the motorized drive compartment. The cooling compartment has two spaced apart, elongated, cylindrical rollers whose longitudinal axes lie in the same horizontal plane and each of which is secured to the end walls of said compartment. Said rollers are mounted sufficiently above the base of said cooling compartment to permit their free rotation within said compartment, and are mounted substantially parallel to each other. Each of said rollers has a horizontally mounted longitudinal drive shaft which extends at one end into the motorized drive compartment. Said rollers are positioned such that a beverage container may be placed above and between them, with its longitudinal axis in the horizontal plane, and be caused to rotate with the rotational movement of said rollers. An elongated segment of a clear, transparent plastic material is secured to the rear wall of said cooling compartment, positioned such that it can support a cooling substance along the periphery of a beverage container placed upon said rollers. Usually, the cooling substance will be ice cubes. However, it may be any other frozen substance which fits into the space allocated to the cooling substance. A clear, transparent plastic top is provided for the cooling compartment to prevent any splash of melting cooling substances into the second compartment. The second compartment contains an electric motor having a drive shaft centrally mounted between the end walls of said compartment. A gear mounted on said motor drive shaft engages two gears, each of which are mounted on the drive shafts of said rollers. Activation of the electrical motor thus causes each roller to be rotated through the gear drive. The motor speed and gear ratios are determined by the circumference of the beverage container to be chilled and the time allowed for chilling. An on-off switch is positioned on the exterior front panel of the housing. A V-shaped opening is provided at the exterior end of the cooling chamber to provide for the easy insertion and removal of beverage containers having long stemmed necks.

In the preferred embodiment, the operation of the cooling device is as follows. The housing top is opened by an upward swing on its hinges. The top of the cooling compartment is slid forward. A beverage container is placed in the cooling compartment on top of and between the two rollers, its longitudinal axis being in the horizontal plane. Depending on size, four to six ice cubes are positioned in the V-shaped groove formed by the angular horizontally oriented inclined ice retaining member and the beverage container, such that the ice cubes are in frictional contact with the beverage container. The top of the cooling compartment is then slid back into a closed position; the top of the housing is swung downward to a closed position; the motor is turned on and the beverage container is rotated against the ice cubes. In case of a standard, twelve fluid ounce, thin wall aluminum beverage container, the motor switch may be turned off after two minutes. The ice cubes will have melted and the temperature of the beverage in the container will be about 40° to 45° F. Times and temperatures will vary according to the speed of rotation of the beverage container, the thermal insulating quality of the container material and the side wall thickness of the container material. Glass beverage containers will take a somewhat longer time to chill. After the beverage container is removed from the cooling compartment, the device is turned over to remove the chilled water resulting from the melted ice cubes.

A second angular horizontally oriented inclined ice retaining member may be secured to the opposite side wall of the cooling compartment to provide for the insertion of additional ice cubes. This would be particularly useful in cooling glass containers.

DESCRIPTION OF THE PREFERRED EMBODIMENT

Figure 1:
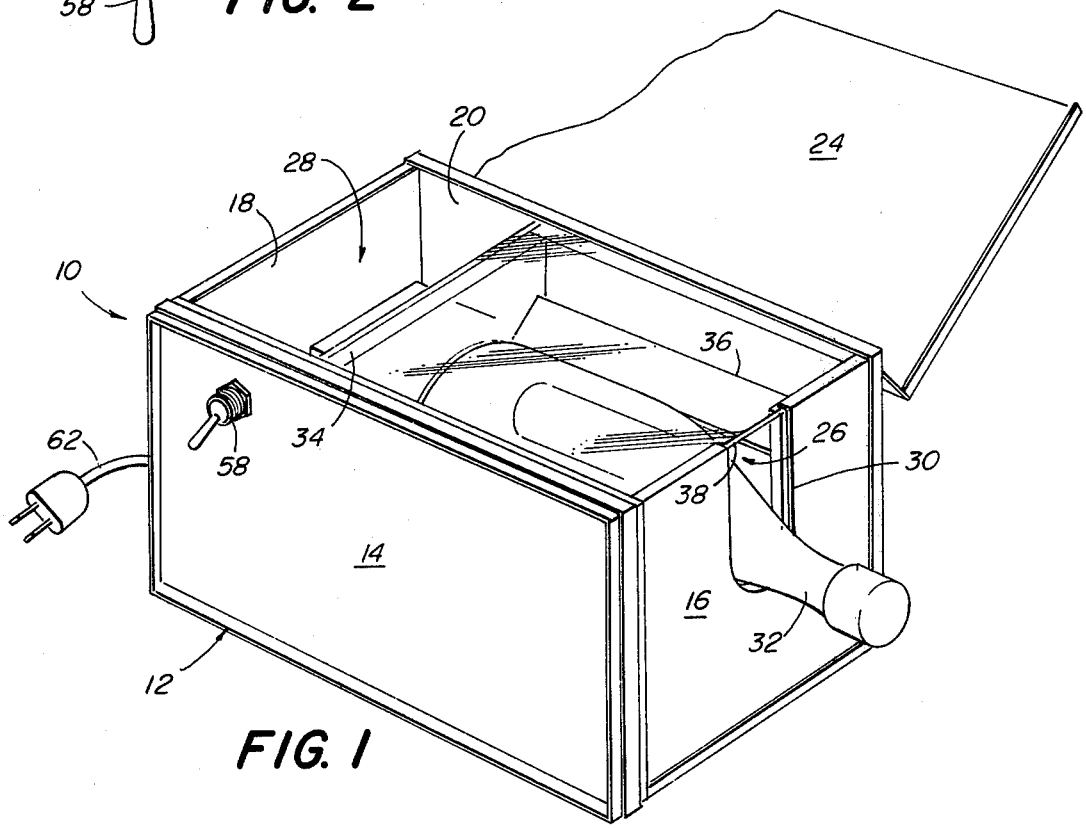
FIG. 1 is a front perspective view of the beverage container cooler of the present invention, with its housing top open and a beverage bottle in position for cooling.

Referring now to the drawings and, in particular, to FIG. 1, the device of the present invention is a motorized beverage container cooler 10, there shown in perspective view. Cooler 10 is enclosed in an outer housing 12 of a substantially rectangular shape, having a front wall 14, side walls 16, 18, rear wall 20, base 22 and a top 24. Top 24 is hinged to the upper edge of rear wall 20 such that top 24 may be opened and closed to permit the insertion and removal of beverage containers and to permit servicing of the motorized mechanism. The interior of housing 12 is subdivided into two compartments, a cooling compartment 26 and a mechanical compartment 28.

In the embodiment illustrated in the drawings and described in detail hereinafter, beverage container cooler 10 as described and illustrated is a size designed for the rapid cooling of commercially available twelve ounce beverage containers, both cans and bottles. Since the twelve ounce bottles vary somewhat in diameter and height, the dimensions and specifications recited herein will pertain to the twelve ounce beverage can which is standardized commercially. Cooler 10 will vary in its performance insignificantly for the various sizes and shapes of twelve ounce bottles. It should be clearly understood that beverage container cooler 10 can be easily adapted to accomodate other sizes of beverage containers by enlarging cooling compartment 26, and altering one or more of the variables which effect its performance, such as the rpm of the motor, the diameter of its rollers and the gear ratio, as should be obvious from the following detailed description.

In the embodiment illustrated in FIG. 1, a generally V-shaped opening 30 is shown in side wall 16 to permit the easy insertion of bottles having elongated necks. A bottle 32 is shown in position for cooling. FIG. 1 also shows that cooling compartment 26 is lined with a transparent plastic material such as Plexiglas or Lexan (trademarks) along its walls and base, its interior side wall 34 serving to separate cooling compartment 26 from mechanical compartment 28. An elongated strip 36 of clear plastic material is angularly disposed downwardly and inwardly from rear wall 44, stopping just short of bottle 32. Depending on size, four to six ice cubes are placed between strip 36 and beverage container 32, the ice cubes resting on the beverage container 32 by force of gravity. A transparent plastic cover is provided for cooling compartment 26. The use of a transparent plastic material in cooling compartment 26 provides a water-tight compartment with fluid impermeable surfaces and also provides full visibility into the cooling compartment 26. The transparent plastic cover 38 prevents splash from melting ice cubes.

Figure 2:
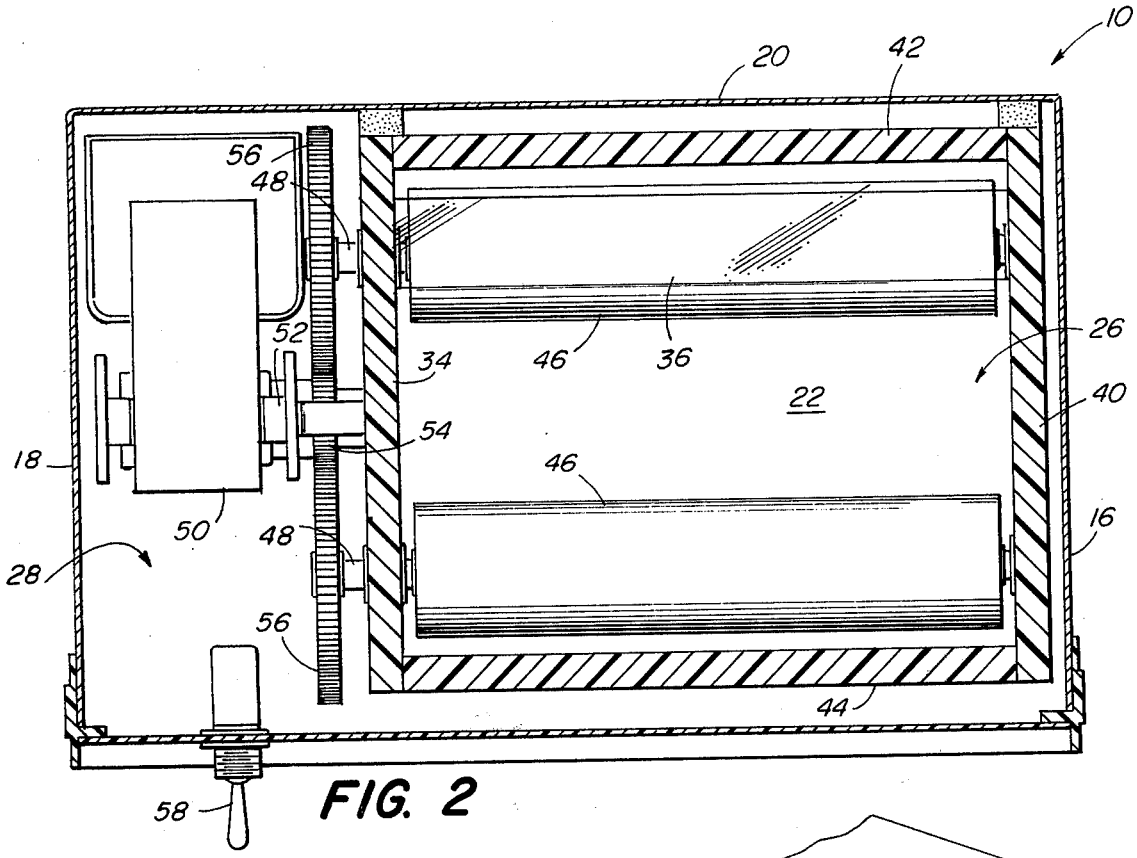
FIG. 2 is a top view of the beverage container of FIG. 1 with the housing top removed.

Referring now to FIG. 2, which is a top view of beverage container cooler 10 with its housing top 24, the plastic top 38 of cooling compartment 26 and beverage container 32 removed, illustrates the interior layout of the components of beverage container cooler 10. The perimeter walls 14, 16, 18 and 20 of housing 20 and the interior plastic walls 34, 40, 42 and 44 of cooling compartment 26 are also shown. As mentioned previously, the specification of the components illustrated in the drawings is given relative to a standard twelve ounce thin wall aluminum can, and are all approximate. Such a can has a height of five inches, a diameter of two and one-half inches and a circumference of eight inches. Two foam-covered rollers having a diameter of one inch and a circumference of three inches are mounted to plastic side walls 34, 40 near the base of said side walls with the longitudinal axes of rollers 46 being in a horizontal plane. Rollers 46 are spaced apart such that they can freely rotate within cooler compartment 26 and support a cylindrical beverage container between them. Rollers 46 also have drive shafts 48 which extend through side wall 34 and into mechanical compartment 28.

Referring again to FIG. 2, mechanical compartment 28 provides the location for the driving mechanism of beverage container cooler 10. An electrical motor 50, rated at 2000 rpm in the embodiment illustrated, is mounted to interior side wall 34. Motor 50 has a drive shaft 52 extending inwardly toward interior side wall 34. A motor drive gear 54 having twenty-four teeth is secured to motor drive shaft 52. As mentioned previously, the drive shafts 48 of rollers 46 also extend inwardly to mechanical compartment 28. A spur gear 56 having 64 teeth is mounted on the end of each roller shaft 48 such that gears 56 simultaneously engage gear 54. An on-off switch 58 for motor 50 is mounted on the front panel 14 of housing 12. When motor 50 is turned on by switch 58, gear 54 drives gears 56, which, in turn cause rollers 46 to rotate. The gear ratio is two and two-thirds-to-one, thus rollers 46 turn at about 780 rpm. Since the roller 46 to beverage can ratio is three-to-eight, the standard size beverage can will rotate at about 300 rpm. The standard power line cord 62 is shown in FIG. 1 but the electrical wiring is not shown in the drawings.

Figure 3:
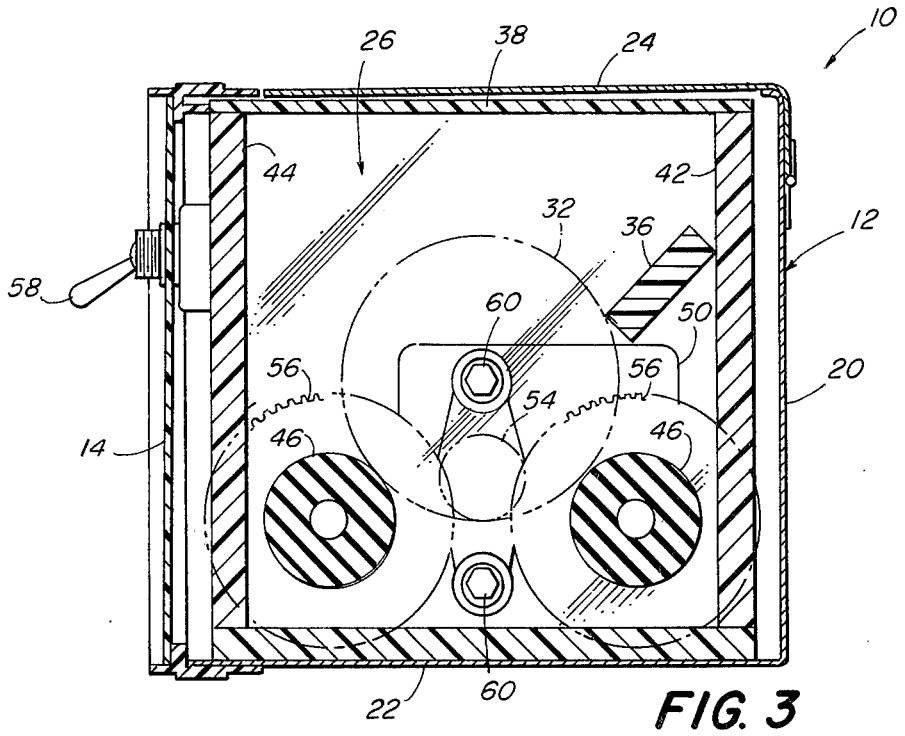
FIG. 3 is an end view of the beverage container cooler of FIG. 1 taken from the end adjacent to the motor-gear compartment.

FIG. 3 is an end view of beverage container cooler 10. This view shows the relative positions of motor drive gear 54, roller gears 56, on-off switch 58, rollers 46, beverage container 32 within housing 12. FIG. 3 also shows the positions of motor 50 and motor mounts 60. This Figure also illustrates the position of ice cube retaining strip 36 relative to beverage container 32. When ice cubes are placed on retaining strip 36 and beverage container 32 is rotated clockwise, the ice cubes will be retained against the side perimeter wall of beverage container 32. Using one inch thick ice cubes and rotating beverage container 32 at 300 rpm, the ice cubes will melt in two minutes and the interior temperature of the beverage in an aluminum container can be reduced from 75° F. to 45° F.

Figure 4:
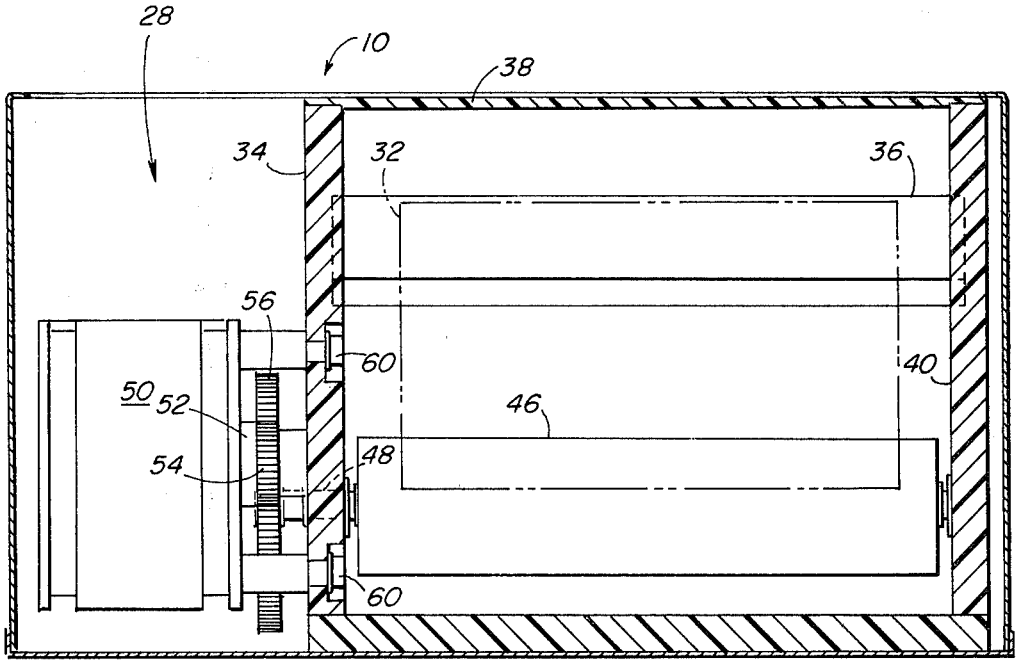
FIG. 4 is a side elevational view of the beverage container cooler of FIG. 1.

FIG. 4 is a side elevational view of beverage cooler 10, showing the relative positions of beverage container 32, rollers 46, roller gears 56 and motor 50. FIG. 4 also shows the relative positions of motor mounts 60 by which motor 50 is secured to interior wall 34.

In operation, beverage container cooler is utilized as follows. After connection to a source of electrical power, the hinged top 24 is opened and the plastic cover 38 of cooling compartment 26 is removed. A beverage container 32 is placed horizontally between rollers 46. Ice cubes are placed along retaining strip 36 such that the ice cubes abut the perimeter wall of beverage container 32. Plastic cover 38 is replaced in position. Top 24 is closed. Switch 58 is turned on. Motor 50 causes rollers 46 to rotate through gears 54,56, resulting in a rapid rotation of beverage container against the ice cubes. After two minutes, switch 58 is turned off, beverage container 32 is removed, having the temperature of its contents reduced about thirty degrees F.

It should be clearly understood that the various dimensions, motor speeds and gear ratios may be simply varied to accommodate other sizes of beverage containers. It should be noted that the rapid rotation of a beverage container in device 10 will not cause any significant foaming of the beverage, even if the beverage is carbonated.

A second angular horizontally oriented ice retaining member 36 may be secured to the front wall 44 of cooling compartment 26 to provide for the insertion of additional ice cubes. This would be particularly useful in cooling glass containers.

I claim:

1. A beverage container cooler for rapid chilling of beverages within containers comprising:

a housing having four side walls, a base and a top hinged along one side wall;

a cooling compartment within said housing having four transparent side walls, a base and a removable cover, said cooling compartment being watertight;

a mechanical compartment within said housing adjacent to said cooling compartment;

a pair of cylindrical rollers mounted near the base of the side walls of said cooling compartment such that the longitudinal axis of each of said roller is in the horizontal plane and such that each of said rollers can rotate freely within the cooling compartment;

said rollers being spaced apart sufficiently to support a cylindrical container placed between them;

said rollers having longitudinal drive shafts extending through a side wall separating said cooling compartment from said mechanical compartment;

an angularly disposed ice retaining strip mounted on the rear wall of said cooling compartment sloping downwardly and inwardly to retain a cooling substance in frictional contact with a cylindrical beverage container horizontally positioned on said rollers;

an electrical motor mounted in said mechanical compartment;

a drive shaft extending from said electrical motor;

a drive gear mounted on said drive shaft;

one gear mounted on the drive shaft of each of said roller shafts in said mechanical compartment;

said gear on said motor shaft engaging said gears on said roller shafts;

means for connecting said motor to a source of electrical energy;

an on-off switch to control said motor.

2. The beverage container cooler of claim 1 further including:

a generally V-shaped cut-out in the exterior side walls of the cooling compartment and the housing to accommodate the elongated necks of beverage bottles.

3. The beverage container cooler of claim 1 further including:

a second angularly disposed ice retaining strip mounted on the front wall of said cooling compartment sloping downwardly and inwardly to retain a cooling substance in frictional contact with a cylindrical beverage container horizontally positioned on said rollers.

* * * * *